United States Patent [19]

Beier et al.

[11] Patent Number: 4,920,242

[45] Date of Patent: Apr. 24, 1990

[54] ELECTRIC HIGH-VOLTAGE CIRCUIT BREAKER

[75] Inventors: Helmut Beier; Joaquin-Conrado Bohrdt; Klaus Schuler, all of Berlin, Fed. Rep. of Germany

[73] Assignee: Siemens Aktiengesellschaft, Berlin & Munich, Fed. Rep. of Germany

[21] Appl. No.: 251,107

[22] Filed: Sep. 29, 1988

[30] Foreign Application Priority Data

Sep. 30, 1987 [DE] Fed. Rep. of Germany ..... 3733466

[51] Int. Cl.[5] ..... H01H 33/00

[52] U.S. Cl. ..... 200/148 B; 200/148 R; 200/148 F

[58] Field of Search ..... 200/148 F, 148 B, 148 R

[56] References Cited

FOREIGN PATENT DOCUMENTS 2913379 10/1980 Fed. Rep. of Germany .

7814354 12/1978 France .

*Primary Examiner*—Robert S. Macon

*Attorney, Agent, or Firm*—Kenyon & Kenyon

[57] ABSTRACT

In an electric high-voltage circuit breaker with a hydraulic drive, the piston rod, going through a seal, is brought out of the hydraulic cylinder in order to actuate the movable contact via a reversing gear and a switching rod. The piston rod is arranged in a protective tube and provided with a guiding ring which guides the piston rod in the protective tube. The piston rod is coupled to a fork head which engages the reversing gear. The hydraulic cylinder is located between two housings for drive parts, the interior spaces of which are heated and ventilated or exhausted. To prevent the formation of condensate water in the interior of the protective tube, there are provided in the hydraulic cylinder passages which connect the interior of the lower housing and the interior of the upper housing, respectively, to the interior of the protective tube. Thereby, the heated air is conducted from the lower housing via the interior of the protective tube into the interior of the upper housing. The electric high-voltage circuit breaker may be of the type using $SF_6$ pressurized gas in an open air installation.

2 Claims, 2 Drawing Sheets

ELECTRIC HIGH-VOLTAGE CIRCUIT BREAKER

BACKGROUND OF THE INVENTION

The present invention relates to an electric high-voltage circuit breaker, the movable contacts of which, arranged in interrupter units supported by support insulators, are actuated via a switching rod of insulating material and a reversing gear at ground potential, by a hydraulic drive, the piston rod of which, going through a seal, is brought out of the hydraulic cylinder and is connected via a fork head provided with a guiding ring on its side facing the piston rod and guided in a protective tube, to the reversing gear, and in which the hydraulic cylinder is located between two housings for parts of the drive, in the interior spaces of which a heater and connections for ventilating and exhausting are arranged.

Such a design of an electric high-voltage circuit breaker is generally customary and is known particularly from DE-AS 29 13 379. During the switching of such an electric high-voltage circuit breaker mounted in the open, the piston rod coming from the hydraulic cylinder moves back and forth. Thereby, the seal between the hydraulic cylinder and the piston rod is heavily stressed, since the danger exists that impurities are deposited on the extended part of the piston rod such as dust or moisture, so that also corrosion phenomena can occur. For this reason, a protective tube is provided, the length of which is made so that the fork head connected to the piston rod remains also in extended condition (ON-position of the breaker) with its side facing the piston rod and provided with a guiding ring in the protective tube.

SUMMARY OF THE INVENTION

It is an object of the invention to further improve the shielding of the piston rod provided by the protective tube from the outer space.

The above and other object of the invention are achieved by an electric high-voltage circuit breaker of the type described at the outset, wherein passages in the hydraulic cylinder which connect the inner spaces of both housings to the interior space of the protective tube are provided. These passages allow during the off motion a pressure equalization for the air in the interior of the protective tube. By connecting the interior of the protective tube to two interior spaces of housings for parts of the drive, which are heated to prevent the formation of condensate water and are ventilated and exhausted, it is assured also for this interior space of the protective tube that no condensate water can form on the piston rod. This prevents corrosion phenomena caused by moisture which might have gotten into the interior of the protective tube. This would result in undesirable roughening of the piston rod surface and accordingly, an increase of the roughness depth which could cause damage to the seals between the hydraulic cylinder and the piston rod.

The use of passages for connecting the spaces to each other has the advantage over pipe connections that threaded pipe joints are eliminated, which are prone to breaker frame distortions due to shock forces and easily can become leaky.

It is furthermore advantageous if the passage connected to the interior of the lower housing is located below and the passage leading to the interior of the upper housing is located above the longitudinal axis of the piston rod. Thereby, a certain chimney effect is obtained which further promotes the rising of the heated air which got from below from the interior of the lower housing into the interior of the protective tube. Thus, continuous air circulation over the interior of the protective tube is provided.

BRIEF DESCRIPTION OF THE DRAWINGS

The invention will be explained further in the following with the aid of the embodiment shown in FIGS. 1 and 2 of the drawings.

DETAILED DESCRIPTION

Figure 1:
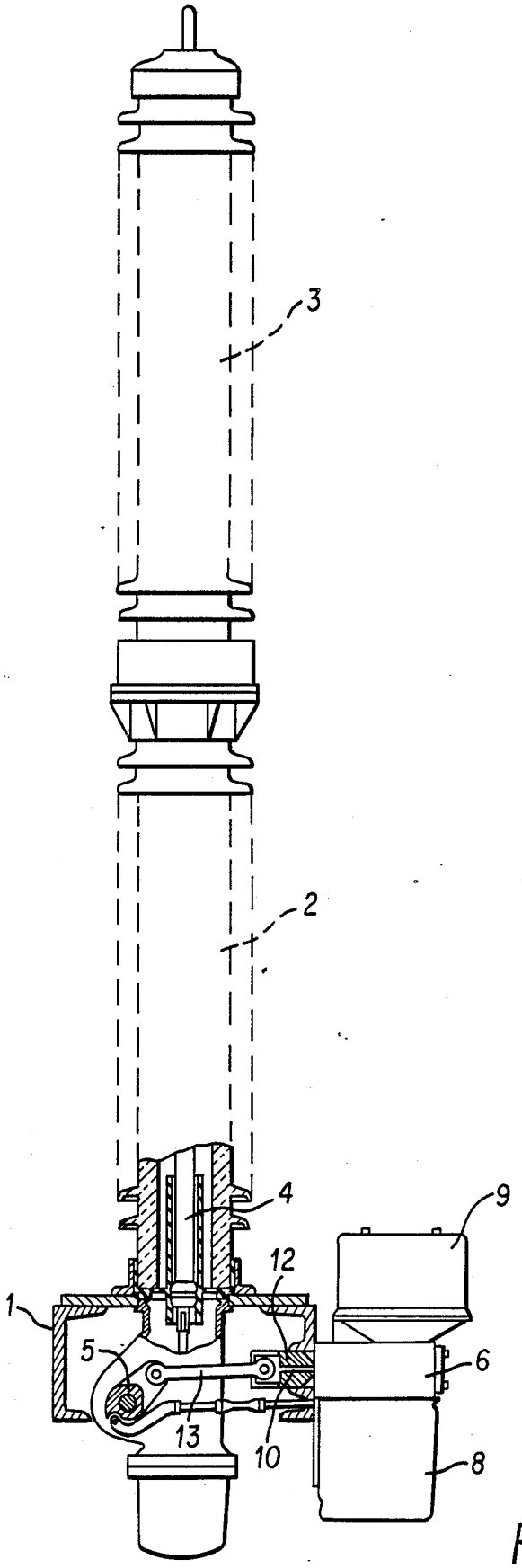
FIG. 1 shows schematically and partly in a cross section, an electric high-voltage circuit breaker.

In an electric high voltage circuit breaker, especially a pressurized-gas high-voltage circuit breaker operated with $SF_6$ and intended for installation in the open air, the support insulators 2 are arranged on a breaker frame 1 which supports the breaker housings 3, in which the interrupter units, not shown, with the stationary and movable contacts, are located. The movable contact of the interrupter unit is actuated by a hydraulic drive 6 via a switching rod 4 of insulating material which goes through the support insulator 2 and a reversing gear 5 located in the breaker frame 1 at ground potential. The hydraulic cylinder 7 of the hydraulic drive 6 supports the lower housing, namely, the drive housing 8. In the latter, auxiliary switches, not shown, are located, among other things. The upper housing, the oil tank 9, is located above the hydraulic cylinder 7.

The piston rod 10 of the hydraulic drive 6 is brought out of the hydraulic cylinder 7 and goes through the seal 11. It is connected to the reversing gear 5 by means of a fork head 12 and a coupling rod 13. Since the piston rod 10 is moved back and forth during the switching movement, so that it is located, depending on the switch position, either mostly outside or inside the hydraulic cylinder 7, a protective tube 14 which surrounds the piston rod 10, is provided at the end face of the hydraulic cylinder 7. The length of this protective tube 14 is designed so that the fork head 12 provided with a guiding ring 16 on its side 15 facing the piston rod 10 is still located within the protective tube 14 also in the most extended position of the piston rod 10 (ON position of the breaker). The interior 17 of the protective tube 14 is therefore always closed toward the outside by the fork head 12 with the guiding ring 16.

Thus, also the extended part of the piston rod 10 is always located in the interior 17 of the protective tube 14. Nevertheless, it cannot be precluded with certainty that the formation of condensate water can occur in this interior space 17 due to atmospheric conditions. For this reason, there is provided in the hydraulic cylinder 7 a passage 18 below the longitudinal axis of the piston rod 10; this passage connects the interior 19 of the drive housing 8 to the interior 17 of the protective tube 14. A second passage 20 in the hydraulic cylinder 7 is located above the longitudinal axis of the piston rod 10 and connects the interior 17 of the protective tube 14 to the interior 21 of the oil tank 9.

To prevent the formation of condensate water, the interior 19 of the drive housing 8 is equipped with a heater 22 and furthermore has a pipe connection 23 for ventilation and exhaust. This pipe connection 23 is located on the underside of the drive housing 8, so that if desired, condensate water can also be drained from it.

Also the interior 21 of the oil tank 9 is provided with a heater 24. In this manner, the passages 18 and 20 connect the interior 17 of the protective tube 14 to the interior 19 of the drive housing 8 as well as to the interior 21 of the oil tank 9. Thereby, two heated spaces are connected to each other. This means that the rising heated air coming from the heaters 22, 24, as is indicated in FIG. 2 by wavy lines rises from the interior 19 of the drive housing 8 into the interior 21 of the oil tank 9 via the interior 17 of the protective tube 14.

Figure 2:
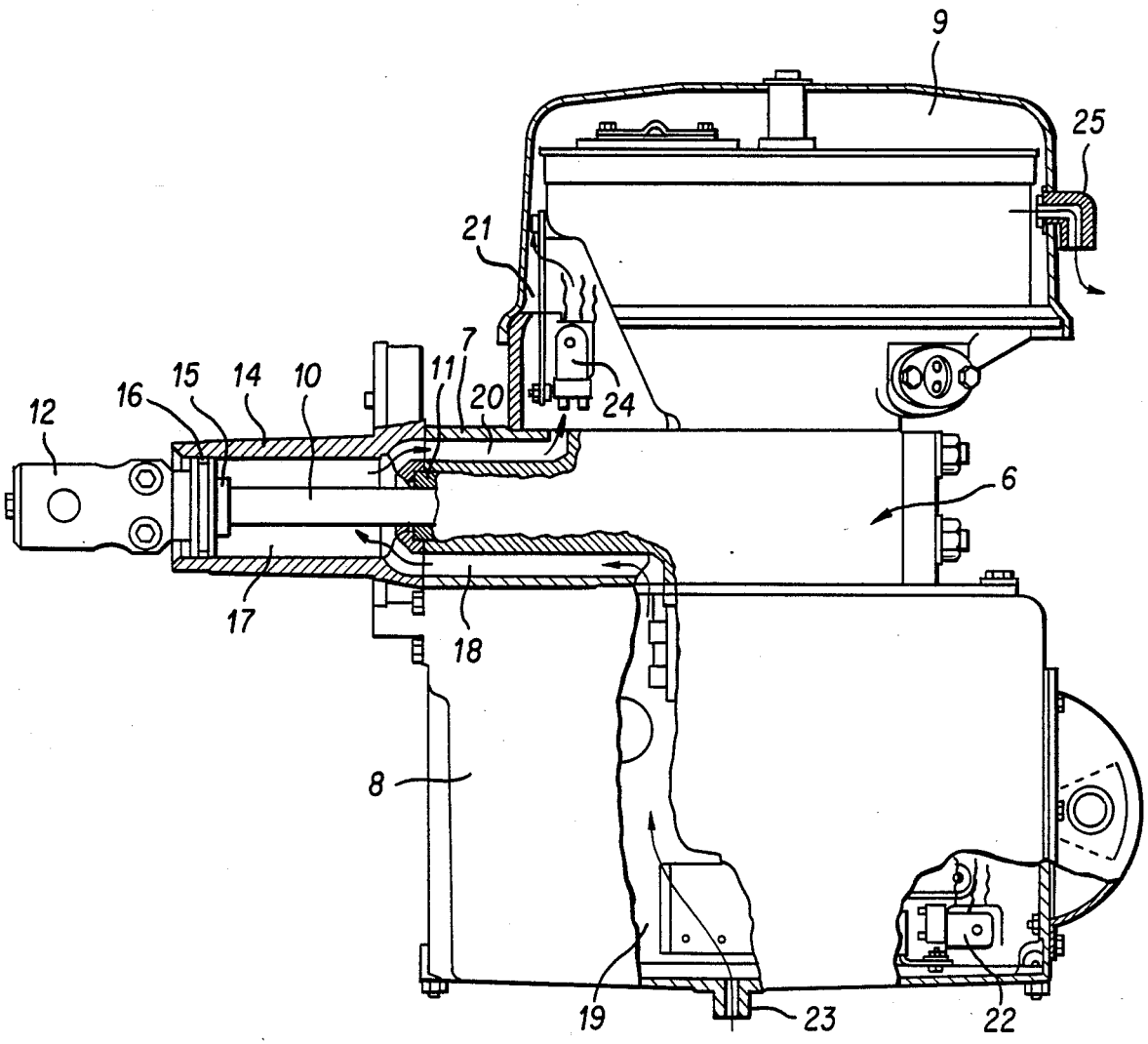
FIG. 2 shows the drive housing with the hydraulic cylinder and the oil tank of the circuit breaker enlarged and likewise partly in cross section.

Since furthermore, the passage 18 between the interior 19 of the drive housing 8 is located below the longitudinal axis of the piston rod 10 and the passage 20 is located between the interior 17 of the protective tube 14 and the interior 21 of the tank 9 above is located above this longitudinal axis of the piston rod 10, a chimney effect is obtained which results in continuous air circulation, as is indicated in FIG. 2 by arrows. It is prevented thereby with certainty that moisture can be deposited on the piston rod 10 or condensate water can precipitate, so that no corrosion phenomenon of any kind can occur.

In the foregoing specification, the invention has been described with reference to a specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An electric high-voltage circuit breaker, wherein movable contacts are supported by support insulators and arranged in an interrupter unit and actuated by a switching rod of insulating material and a reversing gear at ground potential by a hydraulic drive, the hydraulic drive having a piston rod extending through a seal and being brought out of a hydraulic cylinder and connected by a fork head guided in a protective tube and, on a side facing the piston rod being provided with a guiding ring connected to the reversing gear, the hydraulic cylinder being disposed between two housings for parts associated with the drive, in the interior spaces of which housings a heater and connections for ventilation and exhaust are arranged, passages being provided in the hydraulic cylinder for connecting the interior spaces of both housings to the interior of the protective tube.

2. The electric high-voltage circuit breaker recited in claim 1, wherein a first passage is connected to the interior of a lower housing and is located underneath the longitudinal axis of the piston rod and a second passage leading to the interior of the upper housing is located above the longitudinal axis of the piston rod.

* * * * *